US007246957B2

(12) United States Patent
Ouchi

(10) Patent No.: US 7,246,957 B2
(45) Date of Patent: Jul. 24, 2007

(54) SERIAL PRINTER WITH PRINT-MEDIUM DETECTING FUNCTION

(75) Inventor: Tetsuya Ouchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 259 days.

(21) Appl. No.: 11/094,300

(22) Filed: Mar. 31, 2005

(65) Prior Publication Data

US 2005/0220524 A1 Oct. 6, 2005

(30) Foreign Application Priority Data

Mar. 31, 2004 (JP) ..... 2004-103914

(51) Int. Cl.
*B41J 29/38* (2006.01)
*B41J 2/01* (2006.01)

(52) U.S. Cl. ..... 400/76; 347/104

(58) Field of Classification Search ..... None
See application file for complete search history.

(56) References Cited

U.S. PATENT DOCUMENTS

| | | | | |
|---|---|---|---|---|
| 5,644,348 | A * | 7/1997 | Shimoyama et al. | 347/37 |
| 2006/0071390 | A1* | 4/2006 | Johnson et al. | 271/10.01 |
| 2006/0274138 | A1* | 12/2006 | Nunokawa | 347/104 |
| 2007/0057447 | A1* | 3/2007 | Asada et al. | 271/272 |

FOREIGN PATENT DOCUMENTS

| | | |
|---|---|---|
| EP | 3 000 275 | 1/1991 |
| EP | 0 556 045 | 8/1993 |
| EP | 1 096 780 | 5/2001 |
| JP | 63098477 | 4/1988 |

OTHER PUBLICATIONS

European Search Report for Application No. 05251984.0; dated Aug. 2, 2005.

* cited by examiner

*Primary Examiner*—Daniel J. Colilla
(74) *Attorney, Agent, or Firm*—Banner & Witcoff, Ltd

(57) ABSTRACT

A print head and a detector are mounted on a carriage of a serial printer. An information acquiring portion acquires information for determining whether to detect a print medium. An existence-detection determining portion determines whether to detect existence of the print medium based on the information acquired by the information acquiring portion. An existence-detection controlling portion controls, when the existence-detection determining portion determines that detection should be performed, the carriage to move to a position at which the detector confronts a print-medium conveying path and controls the detector to detect the existence of the print medium prior to printing. A print controlling portion controls the print head and the carriage to print the image based on the print data. The print controlling portion prohibits the print head and the carriage from printing the image based on the print data when the detector detects no print medium.

26 Claims, 10 Drawing Sheets

SERIAL PRINTER WITH PRINT-MEDIUM DETECTING FUNCTION

BACKGROUND OF THE INVENTION

1. Field of the Invention

The present invention relates to a serial printer, an inkjet serial printer, and a serial printer with a facsimile function, and more particularly to the aforementioned serial printers that execute a process to prevent images from being printed on a platen of the printer.

2. Description of Related Art

In conventional serial printers, printing is performed regardless of whether a print medium is present over the platen, resulting in wasteful ink consumption. If ink or another printing material is left deposited on the platen, this ink may become deposited on subsequently conveyed print media, soiling the underside hereof. A printing device was proposed in Japanese examined patent-application publication (kokoku) No. HEI-7-108593 to resolve this problem. In this printing device, a sensor is provided on the print head for detecting the print medium. The sensor detects the existence of the print medium prior to the printing operation, and the printing device only executes the printing operation when paper is present.

SUMMARY OF THE INVENTION

However, detecting a print medium using the sensor provided on the print head prior to the printing operation lengthens the printing time from the moment the user issues a print command until the printed results are outputted. This is particularly troublesome when the user wishes to emphasize printing time over printing quality.

In view of the foregoing, it is an object of the present invention to provide a serial printer, inkjet serial printer, and serial printer with facsimile function that perform a process to prevent images from being printed on the platen, while taking into account printing quality and printing time.

In order to attain the above and other objects, the present invention provides a serial printer. The serial printer includes a main body, a carriage, a print head, a detector, an information acquiring portion, an existence-detection determining portion, an existence-detection controlling portion, and a print controlling portion. The main body is formed with a print-medium conveying path through which a print medium is conveyed in a conveying direction. The print medium has a width in a width direction substantially perpendicular to the conveying direction. The carriage is movable, with respect to the main body, reciprocatingly in the width direction. The print head is mounted on the carriage for printing an image on the print medium based on print data. The detector is disposed at the carriage for detecting the print medium. The information acquiring portion acquires information for determining whether to detect the print medium. The existence-detection determining portion determines whether to detect existence of the print medium based on the information acquired by the information acquiring portion. The existence-detection controlling portion controls, when the existence-detection determining portion determines that detection should be performed, the carriage to move to a position at which the detector confronts the print-medium conveying path and controls the detector to detect the existence of the print medium prior to printing. The print controlling portion controls the print head and the carriage to print the image based on the print data. The print controlling portion prohibits the print head and the carriage from printing the image based on the print data when the detector detects no print medium.

BRIEF DESCRIPTION OF THE DRAWINGS

The above and other objects, features and advantages of the invention will become more apparent from reading the following description of the embodiments taken in connection with the accompanying drawings in which:

FIG. 4(*b*) is an explanatory diagram showing the construction of a media sensor shown in FIG. 4(*a*);

FIG. 5(*b*) is an explanatory diagram illustrating a printing mode selection menu;

DETAILED DESCRIPTION OF THE PREFERRED EMBODIMENTS

Figure 1:
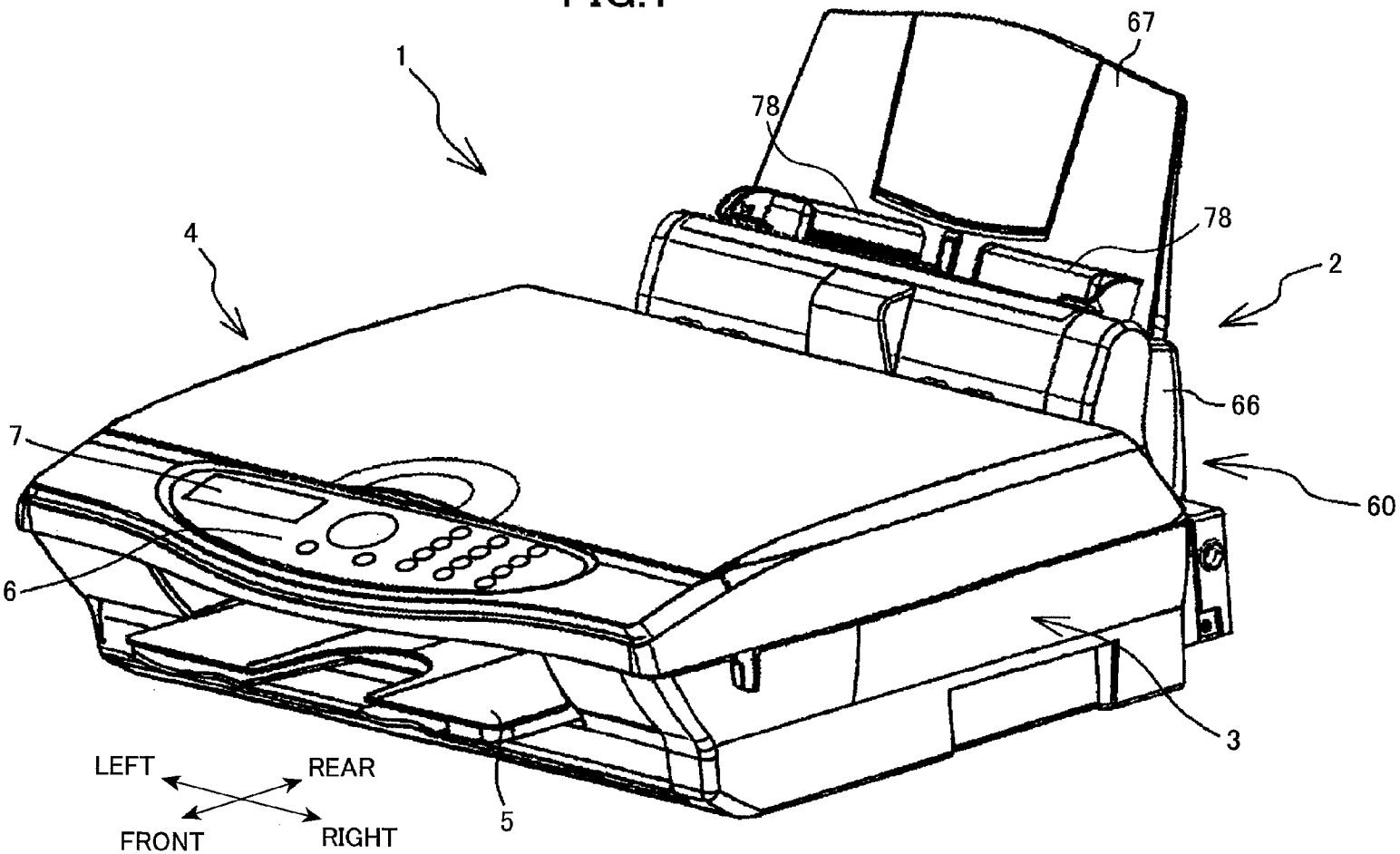
FIG. 1 is a perspective view of a multifunction device according to an embodiment of the present invention.

A multifunction device according to embodiments of the present invention will be described while referring to the accompanying drawings wherein like parts and components are designated by the same reference numerals to avoid duplicating description.

In the embodiments, the present invention is applied to a multifunction device 1 having a printer function, a copier function, a scanner function, a facsimile function, a telephone function, and the like.

FIG. 1 is a perspective view of the multifunction device 1 according to an embodiment of the present invention.

As shown in FIG. 1, a paper supplying unit 2 is provided in the rear section of the multifunction device 1. An inkjet printer 3 is provided in front of and below the paper supplying unit 2. A scanning unit 4 for implementing the copier function and facsimile function is provided above the printer 3. A discharge tray 5 is provided on the front side of the printer 3. An operating panel 6 and an LCD panel 7 are provided on the top surface on the front end of the scanning unit 4.

Figure 2:
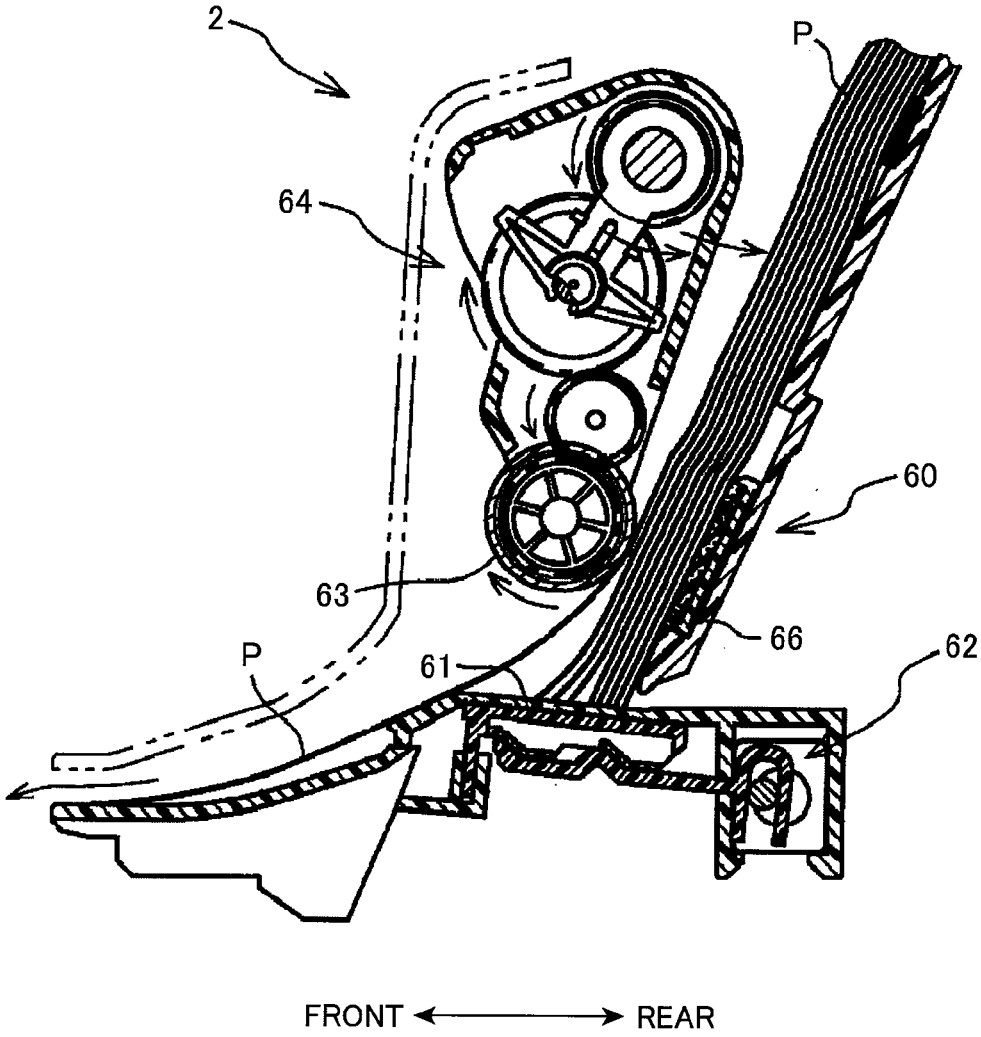
FIG. 2 is a vertical cross-sectional view showing a paper feeding unit provided in the multifunction device.

Next the paper-supplying unit 2 will be described in greater detail with reference to FIG. 2. FIG. 2 is a vertical cross-sectional view showing the paper-supplying unit 2 of the multifunction device 1.

Figure 4A:
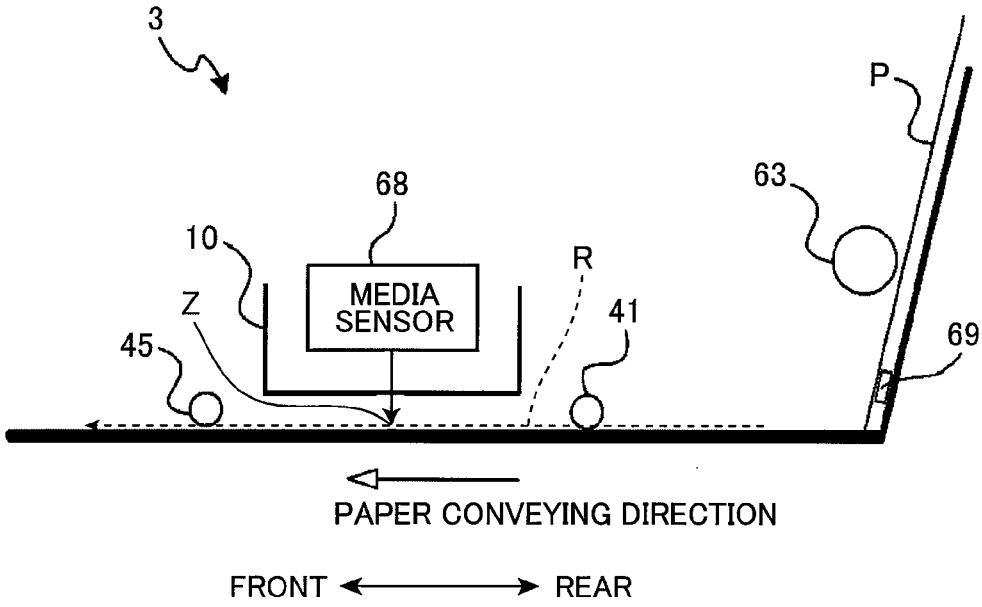
FIG. 4(*a*) is an explanatory diagram showing the layout of the primary components in the printer.
Figure 4B:
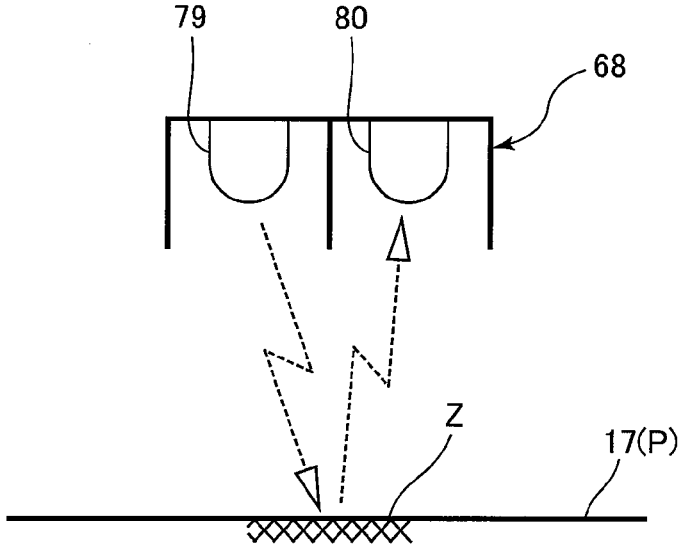
Figure 5A:
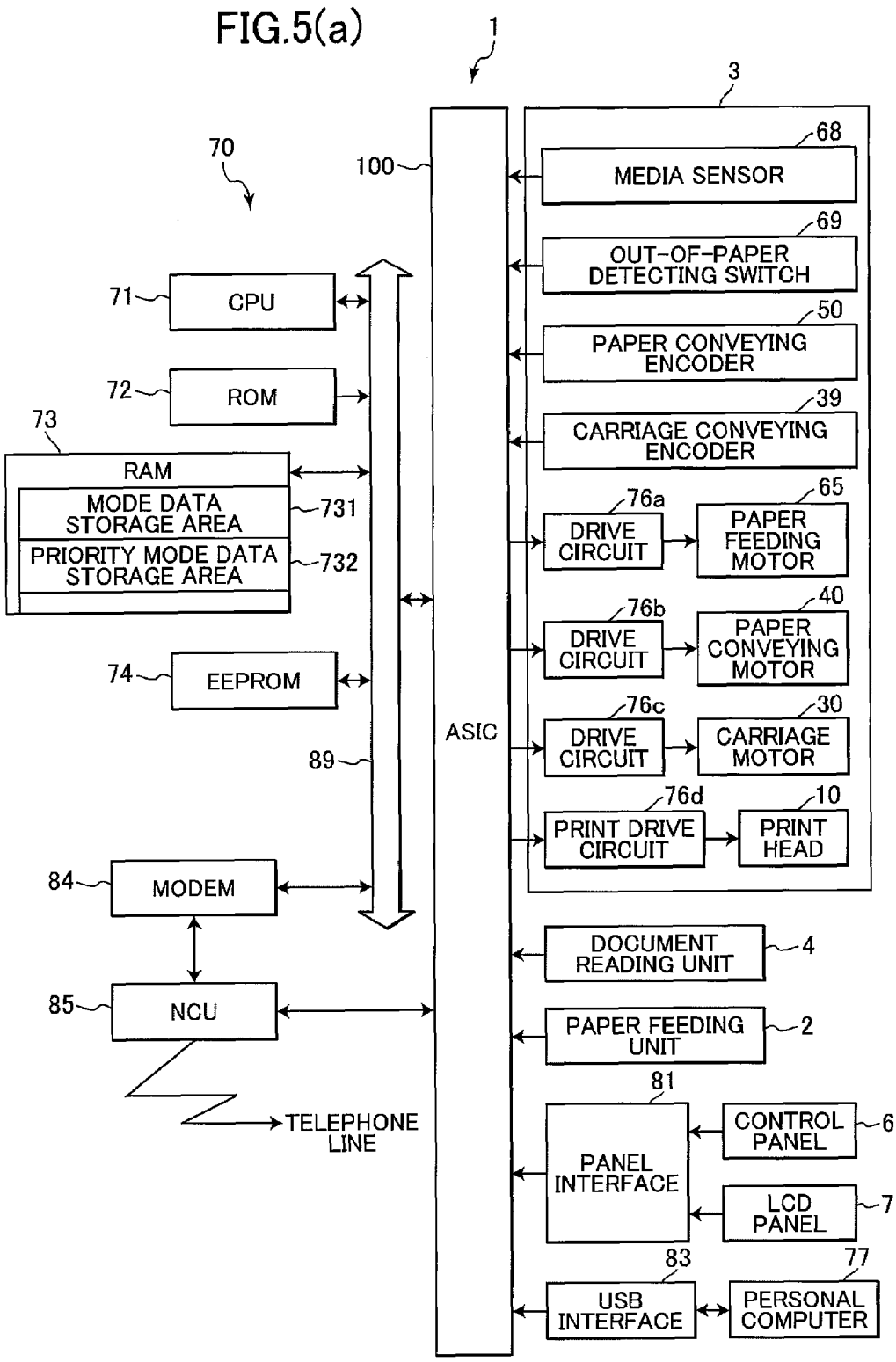
FIG. 5(*a*) is a block diagram showing the electrical configuration of the multifunction device.
Figure 5B:
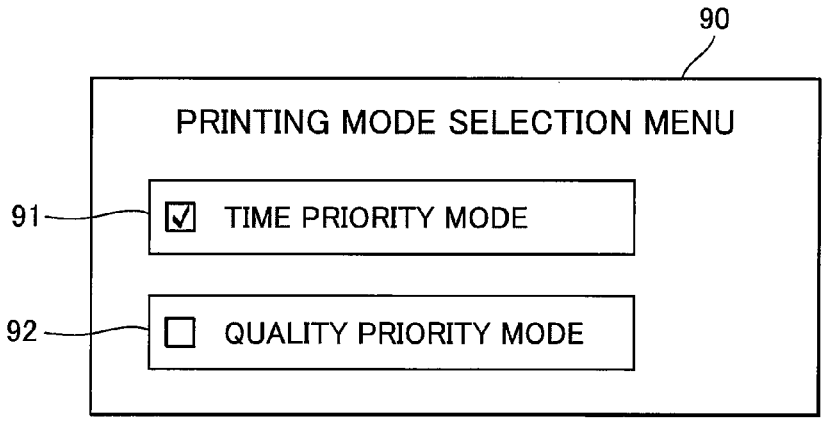

As shown in FIG. 2, the paper-supplying unit 2 includes a paper holder 60, a pair of left and right stoppers 61, a stopper position switching mechanism 62, a paper-supplying mechanism 64 having a paper-feeding roller 63, a paper feeding motor 65 (FIG. 5(*a*)), and an out-of-paper detecting switch 69 (FIGS. 4(*a*) and 5(*a*)). The paper holder 60 holds paper P, serving as the recording medium, in a sloped posture. The pair of left and right stoppers 61 is disposed on the bottom surface side of the paper holder 60. The stopper position switching mechanism 62 toggles the pair of left and right stoppers 61 between an upper position and a lower position. The paper-feeding roller 63 supplies the paper P loaded on the paper holder 60. The paper feeding motor 65 drives the stopper position switching mechanism 62 and the paper-supplying mechanism 64. The out-of-paper detecting switch 69 detects whether or not the paper P is set on the paper holder 60.

The paper holder 60 has a sloped wall section 66, which is formed integrally with the printer case. An extended paper guide plate 67 (see FIG. 1) is detachable to the sloped wall section 66. A pair of paper guides 78 are provided on the sloped wall section 66 for holding the left and right sides of the paper P, as shown in FIG. 1. When either one of the paper guides 78 is moved in the left or right direction, the other paper guide 78 follows this movement by moving in the opposite direction. In other words, the left and right paper guides 78 are configured to move symmetrically to one another in a left-to-right direction. Hence, the widthwise center of the paper P is always fixed in the same position regardless of the size of the paper P.

Figure 3:
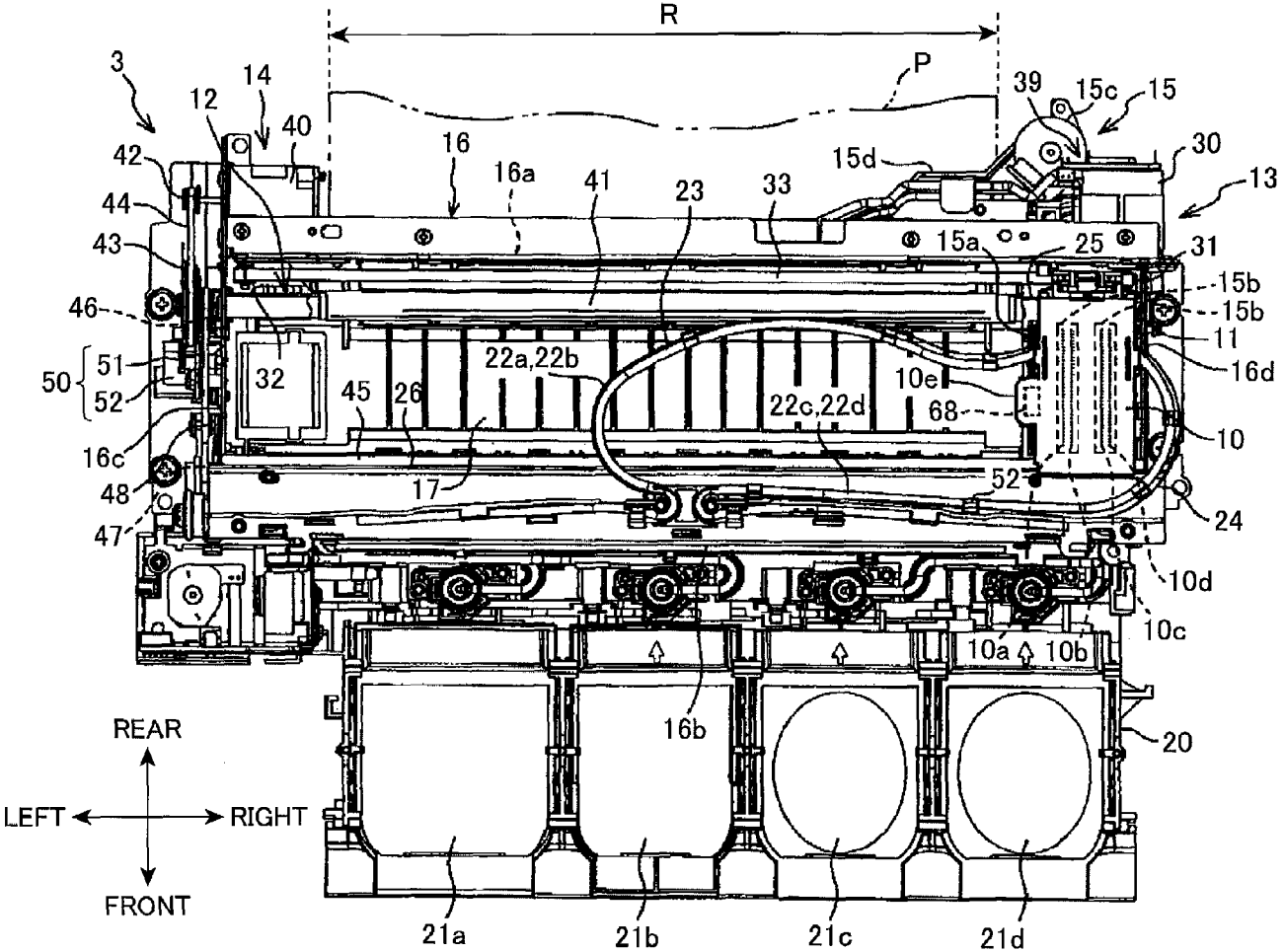
FIG. 3 is a plan view illustrating the internal construction of a printer in the multifunction device.

Next the printer 3 will be described in greater detail with reference to FIGS. 3 and 4(*a*). FIG. 3 is a plan view illustrating the internal construction of the printer 3 in the multifunction device 1. FIG. 4(*a*) is an explanatory diagram showing the layout of the primary components in the printer 3. Note that the downward direction in the drawing sheet of FIG. 3 corresponds to the front direction (the discharge tray 5 side) of the multifunction device 1, and that the leftward direction in the drawing sheet of FIG. 4(*a*) corresponds to the front direction of the multifunction device 1.

As shown in FIGS. 3 and 4, the printer 3 includes a print head 10, a carriage 11, a guide mechanism 12, a carriage moving mechanism 13, a paper conveying mechanism 14, and a maintenance mechanism 15 for the print head 10. The print head 10 is mounted on the carriage 11. The guide mechanism 12 supports and guides the carriage 11 so that the carriage 11 can move reciprocally in a scanning direction, which is the left-to-right direction in FIG. 3. The carriage moving mechanism 13 moves the carriage 11 in the left-to-right direction. The paper conveying mechanism 14 conveys paper supplied by the paper supplying unit 2.

A rectangular frame 16 that is long in the left-to-right dimension and that is short in the front-to-rear direction is provided in the printer 3. Various components are mounted on the rectangular frame 16, including the guide mechanism 12, carriage moving mechanism 13, paper conveying mechanism 14, and maintenance mechanism 15. The print head 10 and carriage 11 are also accommodated inside the rectangular frame 16 so as to be capable of moving reciprocally left and right.

The rectangular frame 16 includes a rear plate 16*a* and a front plate 16*b*. A paper introducing opening and paper discharging opening (not shown) are formed in the rear plate 16*a* and front plate 16*b*, respectively. Paper supplied by the paper supplying unit 2 is introduced into the rectangular frame 16 via the paper introducing opening, conveyed to the front of the rectangular frame 16 by the paper conveying mechanism 14, and discharged through the paper discharging opening onto the discharge tray 5 (FIG. 1) on the front of the multifunction device 1. A black platen 17 having a plurality of ribs is mounted on the bottom surface of the rectangular frame 16. The print head 10 performs a printing operation on paper inside the rectangular frame 16 as the paper moves over the black platen 17.

The print head 10 is provided with four sets of ink nozzles 10*a*-10*d* that point downward. Paper is printed on by ejecting four colors (black, cyan, yellow, and magenta) of ink downward through these sets of ink nozzles 10*a*-10*d*. Since the four sets of ink nozzles 10*a*-10*d* are disposed on the bottom side of the print head 10, their positions are represented by broken lines in FIG. 3.

Ink cartridges 21*a*-21*d* for each of the four colors are mounted in a cartridge holder 20 on the front side of the rectangular frame 16. The ink cartridges 21*a*-21*d* are connected to the print head 10 via four flexible ink tubes 22*a*-22*d* that pass through the rectangular frame 16 in order to supply ink of each of the four colors to the print head 10.

Left and right flexible printed circuits (FPC) 23 and 24 are disposed inside the rectangular frame 16. The left FPC 23 extends together with the flexible ink tube 22*a* and flexible ink tube 22*b* and connects to the print head 10. The right FPC 24 extends together with the flexible ink tube 22*c* and flexible ink tube 22*d* and connects to the print head 10. The left FPC 23 and right FPC 24 include a plurality of signal lines that electrically connect the print head 10 to a control process unit 70 (shown in FIG. 5(*a*)) described later.

The guide mechanism 12 has a guide shaft 25 and a guide rail 26. The guide shaft 25 extends left-to-right in the back part of the rectangular frame 16. The left and right ends of the guide shaft 25 are coupled with a left plate 16*c* and a right plate 16*d*, respectively, of the rectangular frame 16. The guide rail 26 extends left-to-right in the front part of the rectangular frame 16. The rear end of the carriage 11 is fitted over the guide shaft 25 so as to be capable of sliding along the same, while the front end of the carriage 11 is engaged with the guide rail 26 and capable of sliding along the same.

The carriage moving mechanism 13 includes a carriage motor 30, a drive pulley 31, a follow pulley 32, and a belt 33. The carriage motor 30 is mounted on the rectangular frame 16 at the rear side of the rear plate 16*a* on the right end and facing front. The drive pulley 31 is rotatably supported on the right end of the rear plate 16*a* and is driven to rotate by the carriage motor 30. The follow pulley 32 is rotatably supported on the left end of the rear plate 16*a*. The belt 33 is looped around the pulleys 31 and 32 and fixed to the carriage 11. A carriage conveying encoder 39 is disposed near the carriage motor 30 for detecting movement (position) of the carriage 11 (print head 10).

The paper conveying mechanism 14 includes a paper conveying motor 40, a registration roller 41, a drive pulley 42, a follow pulley 43, and a belt 44. The paper conveying motor 40 is mounted facing leftward on the portion of the left plate 16*c* that protrudes further rearward than the rear plate 16*a*. The registration roller 41 extends in the left-to-right direction in the rectangular frame 16 below the guide shaft 25. The left and right ends of the registration roller 41 are rotatably supported in the left plate 16*c* and right plate 16*d*, respectively. The drive pulley 42 is driven to rotate by the paper conveying motor 40. The follow pulley 43 is coupled to the left end of the registration roller 41. The belt 44 is looped around the pulleys 42 and 43. When the paper conveying motor 40 is driven, the registration roller 41 rotates and conveys paper in the rear-to-front direction. While the registration roller 41 is emphasized in FIG. 3, the registration roller 41 is actually disposed beneath the guide shaft 25.

The paper conveying mechanism 14 further includes a discharge roller 45, a follow pulley 46, a follow pulley 47, and a belt 48. The discharge roller 45 extends in the left-to-right direction in the front section of the rectangular frame 16. The left and right ends of the discharge roller 45 are rotatably supported in the left plate 16*c* and right plate 16*d*, respectively. The follow pulley 46 is integrally provided with the follow pulley 43. The follow pulley 47 is coupled to the left end of the discharge roller 45. The belt 48 is looped around the pulleys 46 and 47. When the paper conveying motor 40 is driven, the discharge roller 45 rotates and discharges paper toward the discharge tray 5 in the front of the multifunction device 1.

An encoder disk 51 is fixed to the follow pulley 43. A photo interrupter 52 having a light-emitting unit and a light-receiving unit is mounted on the left plate 16*c* such that the encoder disk 51 is interposed between the light-emitting unit and light-receiving unit. The encoder disk 51 and photo interrupter 52 together make up a paper conveying encoder 50. The control process unit 70 described later controls the driving of the paper conveying motor 40 based on detection signals from the paper conveying encoder 50 (more specifically, from the photo interrupter 52).

The maintenance mechanism 15 includes a wiper 15*a*, two caps 15*b*, and a drive motor 15*c*. The wiser 15*a* wipes the surface of the print head 10. Each of the caps 15*b* can hermetically seal two sets of the ink nozzles 10*a*-10*d*. The drive motor 15*c* drives both of the wiper 15*a* and caps 15*b*. The wiper 15*a*, caps 15*b*, and drive motor 15*c* are mounted on a mounting plate 15*d*. The mounting plate 15*d* is fixed to the lower surface side of the bottom plate of the rectangular frame 16 at its right portion. Since the caps 15*b* are disposed on the bottom side of the print head 10, dotted lines indicate the positions of the caps 15*b* on the opposite side in FIG. 3.

A sensor mounting portion 10*e* protrudes from the left side of the print head 10. A media sensor 68 is mounted on the sensor mounting portion 10*e* for detecting the leading edge and side edges of the paper P. As shown in FIG. 4(*b*), the media sensor 68 is a reflection-type optical sensor that includes a light-emitting element 79 (light-emitting diode in the present embodiment) and a light-receiving element 80 (phototransistor in the present embodiment). When the media sensor 68 emits light from the light-emitting element 79, light reflected from a target detection area Z is received by the light-receiving element 80. If possible, the media sensor 68 should be mounted at least upstream of the ink nozzle groups 10*a*-10*d* in the print head 10 with respect to the paper conveying direction.

Figure 10:
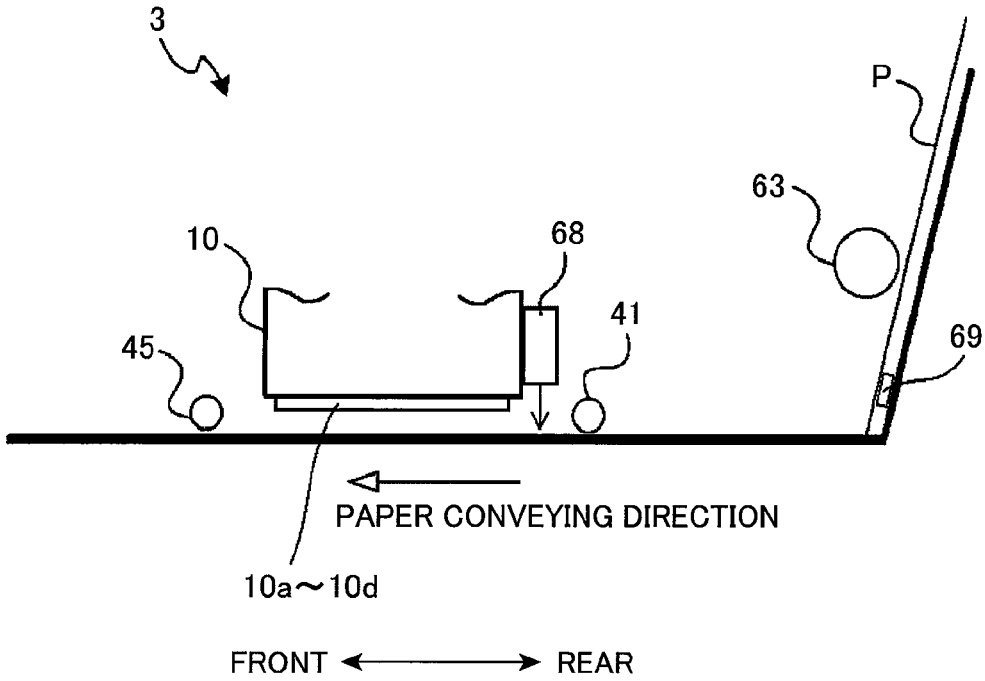
FIG. 10 is an explanatory diagram showing the layout of the primary components in the printer according to another modification.

In the example shown in FIGS. 3 and 4(*a*), a printing operation begins once the media sensor 6B detects the leading edge of the paper P. If the multifunction device 1 must print the leading and side edges of the paper P with no margins, for example, it is necessary to first convey the paper P backwards before beginning the printing operation. However, if the media sensor 68 is mounted at least upstream of the ink nozzle groups 10*a*-10*d* in the paper conveying direction, as shown in a modification in FIG. 10, where upstream is the right side in FIG. 10, it is not necessary to back up the paper P after detection, enabling the printing operation to begin immediately.

Next, the electrical configuration of the multifunction device 1, and particularly the printer 3, will be described with reference to FIG. 5(*a*). FIG. 5(*a*) is a block diagram showing the electrical configuration of the multifunction device 1. As shown in FIG. 5(*a*), the controller 70 of the multifunction device 1 includes a CPU 71 that controls the multifunction device 1, a ROM 72 that stores control programs and the like for controlling operations of the CPU 71, a RAM 73 and an EEPROM 74 for temporarily storing data, and an ASIC 100 (Application Specific Integrated Circuit), all of which components are connected via a bus 89. Connected to the ASIC 100 are a panel interface 81 that handles the printer 3, document reading unit 4, paper feeding unit 2, control panel 6, and LCD panel 7; a USB interface 83 for exchanging image data input and output with an external personal computer 77 or the like; and a network control unit (NCU) 85 and a modem 84 for transmitting data between an external facsimile device via an ordinary public telephone line. The RAM 73 is provided with a mode data storage area 731 for storing data regarding the printing mode and a priority mode data storage area 732 for storing data regarding the priority mode.

The controller 70 is electrically connected to the media sensor 68, paper conveying encoder 50, out-of-paper detecting switch 69, and carriage conveying encoder 39 configuring the printer 3. The controller 70 is also electrically connected to drive circuits 76*a*-76*c* that drive the paper feeding motor 65, paper conveying motor 40, and carriage motor 30, respectively; and a print drive circuit 76*d* for driving the print head 10.

The controller 70 is also connected to and capable of communicating with the personal computer 77. The controller 70 performs a printing process well known in the art based on a print command from the personal computer 77 in order to print on the paper P images represented by image data that is transmitted from the personal computer 77 along with the printing instructions. The print command received from the personal computer 77 includes data describing the paper size on which the image is to be printed (A4, B5, etc.). The multifunction device 1 also has a facsimile function for printing print data included in facsimile data received by the printer 3. The facsimile data also includes data for the paper size. Normally, facsimile data is transmitted and received for a paper size of A4 or larger.

In the multifunction device 1 of the present embodiment, the media sensor 68 detects whether the paper P has been conveyed to a printing position (detects the existence of paper) and detects whether the size of the conveyed paper P has a width equivalent to the paper size indicated by the print data, in order to accurately align the paper P with the image represented by the print data. If the image and the paper P are not accurately aligned, the entire image may not fit on the paper P, and ink nay be ejected at locations that the paper P does not exist, soiling the platen 17 with ink and soiling the underside of the subsequently conveyed paper P. Since images must be reprinted when not printed as desired, the ink usage in this case doubles, increasing ink consumption. Therefore, it is necessary to detect both the existence of the paper and the paper width.

As shown in FIG. 1, the paper P is loaded on the extended paper guiding plate 67 in the multifunction device 1 of the present embodiment. The paper guides 78 maintain the paper P so that a centerline between the paper guides 78 is always at a fixed position. Hence, when the paper P is conveyed to the printing position, the paper P always exists at the centerline, regardless the size of the paper P. Therefore, when detecting the existence of paper, the target detection area Z is the position of the media sensor 68 mounted on the carriage 11 when the carriage 11 is moved to the center of the guide rail 26. When detecting the paper width, the media sensor 68 passes over the entire paper width to detect both side edges of the paper P. Alternatively, the media sensor 68 may detect one side edge of the paper P to calculate the paper width.

The following procedures (1)-(3) are used for determining whether the paper P is present in the target detection area Z:

(1): The light-emitting element 79 is controlled to emit a fixed amount of light. Specifically, a constant electric current (hereinafter referred to as a paper edge detecting current) is supplied to the light-emitting element 79.

(2): The amount of light received by the light-receiving element 80 is detected while the light-emitting element 79 is emitting light as described in (1). Specifically, an output value (voltage in the present embodiment) from the light-receiving element 80 is detected.

(3): If the output value from the light-receiving element 80 detected in (2) exceeds a threshold value (hereinafter referred to as a paper edge detecting threshold), then it is determined that the paper P is present in the target detection area Z. If the output value from the light-receiving element 80 is smaller than the threshold value, then it is determined that the paper P is not present in the target detection area Z.

The existence of the paper P can be determined under these conditions because the output value from the light-receiving element 80 approaches zero when the paper P is not present at the target detection area Z (when the black platen 17 is detected). However, a larger value is outputted from the light-receiving element 80 when the paper P (which is normally white) is present at the target detection area Z.

The time required to perform a printing operation 13 (printing time) is longer when detecting the paper using the control panel 6 than when not detecting the paper, due to the time required for moving the carriage 11. When paper detection is performed for each new page, the printing time becomes longer in proportion to the number of pages. In order to shorten the printing time, the multifunction device 1 of the present embodiment determines whether or not to detect the paper based on the resolution or the print data. The personal computer 77 connected to the multifunction device 1 sets the printing type to one of the following four types: draft print (a resolution of 600×150 dpi or 600×300 dpi), normal print (a resolution of 600×600 dpi or 750×750 dpi), fine print (a resolution of 1200×1200 dpi), and superfine print (a resolution of 1200×2400 dpi or 1200×6000 dpi).

Hence, the multifunction device 1 sorts print data into one of four modes A, B, C, or D according to the image resolution, and sets the frequency for detecting paper for each mode. In Mode A, the multifunction device 1 performs printing without detecting the paper. Hence, Mode A is selected when a fast printing time is the priority or when there is little harm when the paper P is not conveyed or when a paper P of a different size is conveyed. In the present embodiment, Mode A is selected if the resolution is less than or equal to 630×300 dpi; Mode B is selected if the resolution is less than or equal to 750×750 dpi; Mode C is selected if the resolution is less than or equal to 1200×1200 dpi; and Mode D is selected if the resolution is greater than 1200×1200 dpi.

Accordingly, Mode A is selected when performing a draft print, that is, when the resolution is 600×150 dpi or 600×300 dpi. In Mode B, the multifunction device 1 only detects the existence of the paper. This reduces the printing time, since the multifunction device 1 does not detect the width of the paper in Mode B. However, since the existence of the paper is detected, in the present embodiment Mode B is selected when performing a normal print, that is, when the resolution is 600×600 dpi or 750×750 dpi.

In Mode C, the existence of paper and the paper width are detected for the first page only, while only the existence of paper is detected from the second page on. However, if the multifunction device 1 runs out of paper during the printing operation, the paper width is again detected for the first sheet after the multifunction device 1 has seen reloaded with paper. In the present embodiment, Mode C is selected for a fine print, that is, when the resolution is 1200×1200 dpi.

In Mode D, the multifunction device 1 always detects both the existence of paper and the paper width. Mode D is selected for a superfine print in the present embodiment, that is, when the resolution is 1200×2400 dpi or 1200×6300 dpi. Mode D is also selected for facsimile data, which always requires detection of the existence of paper and the paper width because the facsimile data is deleted after printing. Mode D is also selected when the resolution does not match any of the resolutions given above. Data indicating the selected mode is stored in the mode data storage area 731 of the RAM 73. In the present embodiment, a "1" is stored for Mode A, "2" for Mode B, "3" for Mode C, and "4" for Mode D.

The user can perform various settings on the control panel 6 for the printer function, copier function, scanner function, facsimile function, telephone function, and the like. For example, a menu (not shown) displayed on the LCD panel 7 may include the selections "Print," "Copy," "Scan," "Fax," and "Phone." When the user makes a selection, another screen is displayed, enabling the user to select items or input values, in order to register telephone numbers used by the facsimile and telephone functions, set image levels (resolutions) for transmitting images with the facsimile function, set image reading levels (resolutions) of the scanner function, set enlargement/reduction values and number of copies for the copier function, and the like. The user selects items and inputs values by operating various keys provided on the control panel 6.

In the multifunction device 1 of the present embodiment, the user can select a "printing time priority mode" or a "printing quality priority mode" on the control panel 6. For example, the user selects "Print" in the main menu to display a print menu (not shown) including the selection "Printing Mode." When the user selects "Printing Mode," a printing mode selection menu shown in FIG. 5(*b*) is displayed with the selections "Time Priority Mode" 91 and "Quality Priority Mode" 92. In the example of FIG. 5(*b*), the "Time Priority Mode" 91 is selected. A code identifying the selected mode is stored in the priority mode data storage area 732 of the RAM 73. In the present embodiment, a "1" is stored for the "Time Priority Mode," a "2" for the "Quality Priority Mode," and a "0" if neither mode was selected.

Figure 6:
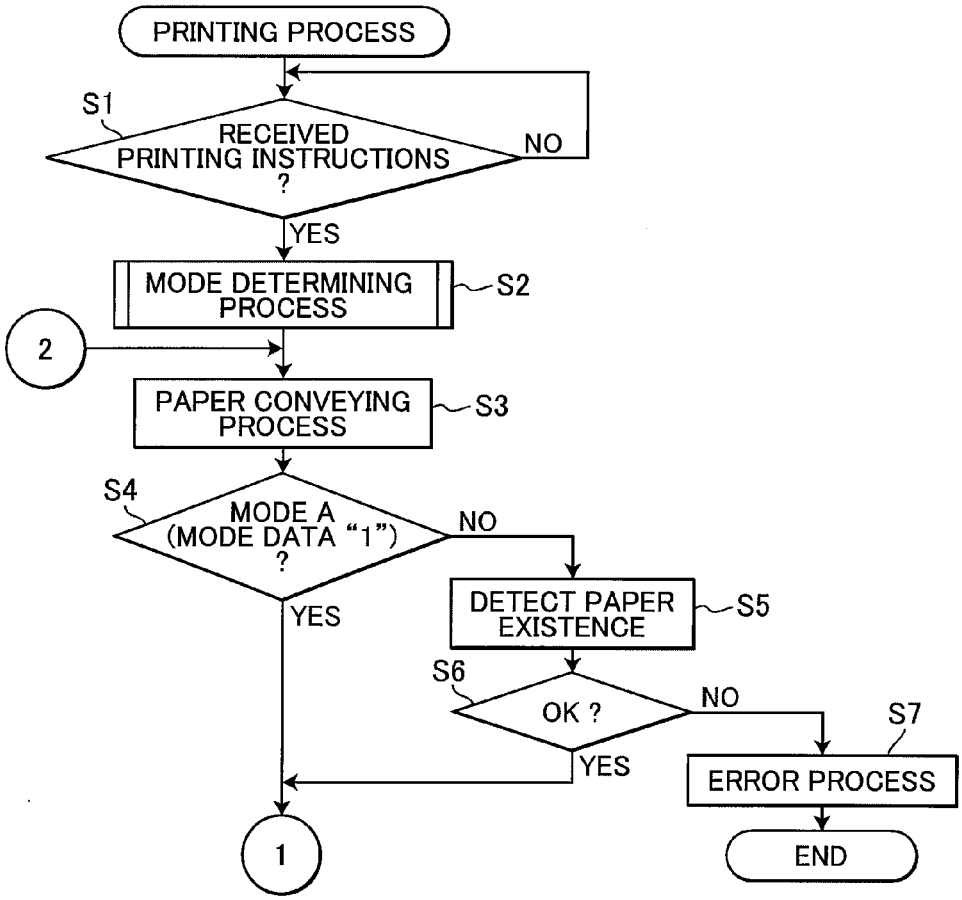
FIG. 6 is a flowchart showing steps in a printing process according to the embodiment of the present invention.
Figure 7:
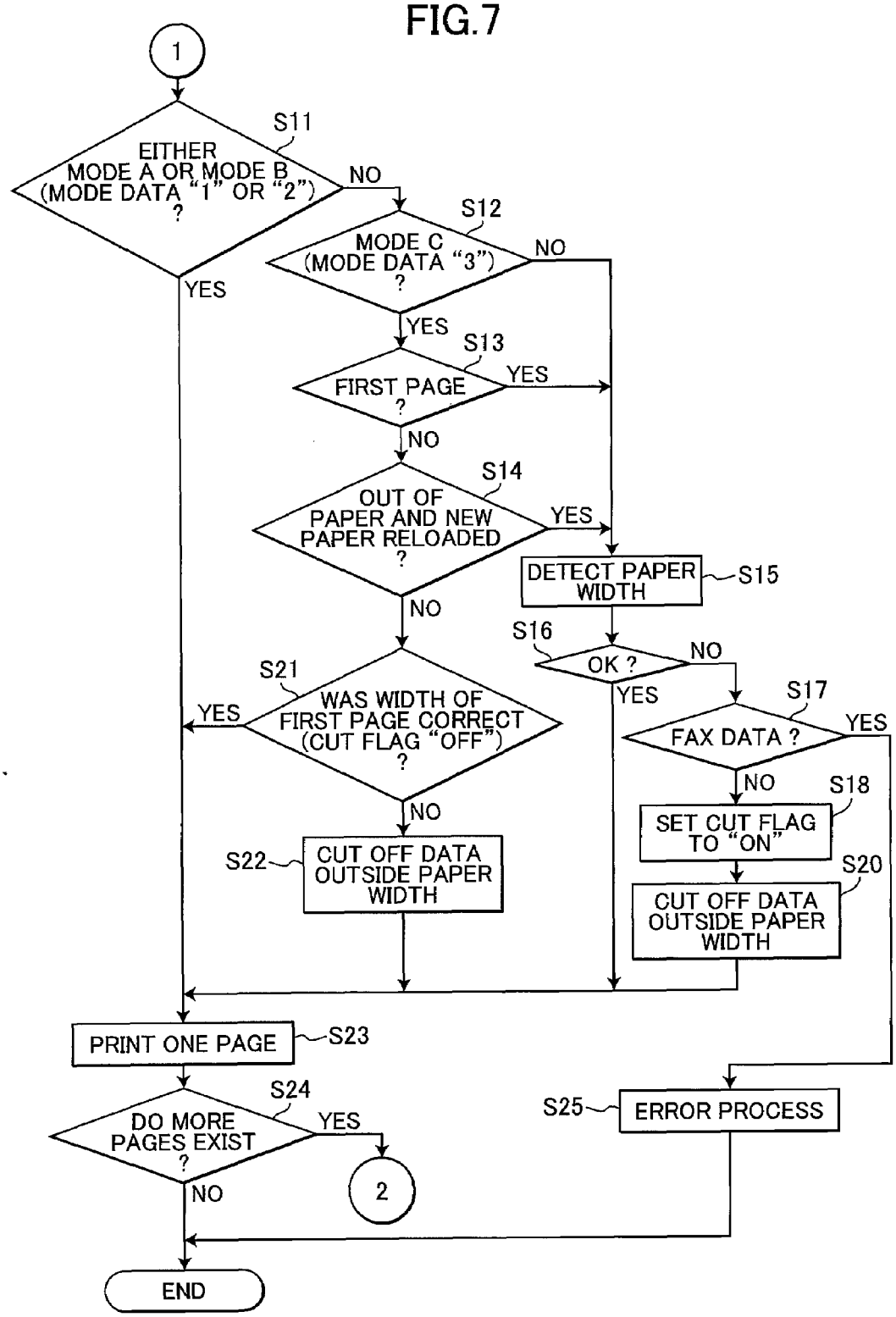
FIG. 7 is a flowchart continuing the printing process of FIG. 6.
Figure 8:
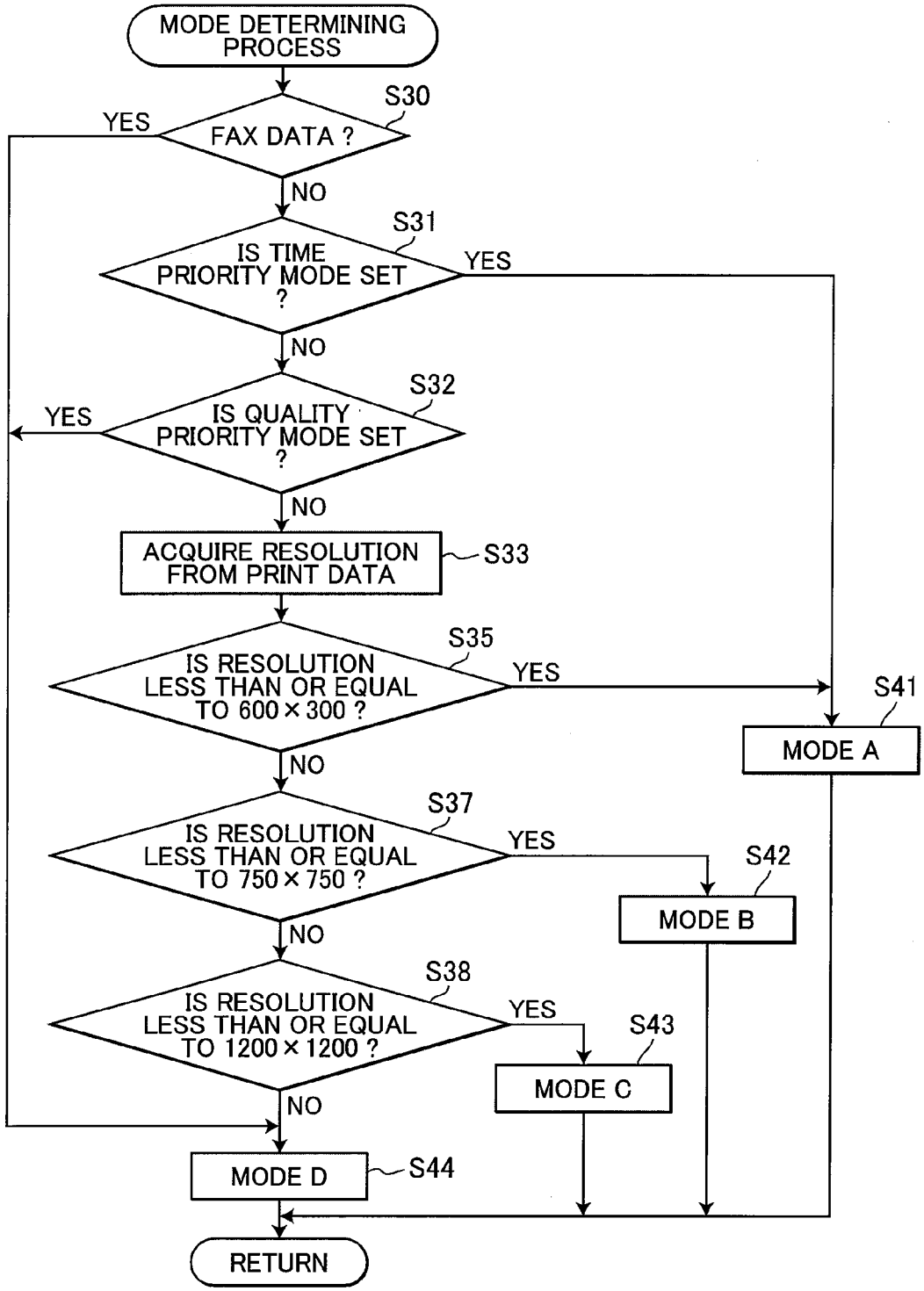
FIG. 8 is a flowchart showing steps in a mode determining process performed during the printing process of FIG. 6.

Next, a detailed control process performed by the controller 70 will be described with reference to flowcharts in FIGS. 6 through 8. FIG. 6 is a flowchart showing steps in a printing process. FIG. 7 is a flowchart continuing the printing process of FIG. 6. FIG. 8 is a flowchart showing steps in a mode determining process performed during the printing process. A flag called a "cut flag" is used in the printing process of the present embodiment. The cut flag is set to "1", or "ON", when the size of the paper P loaded in the paper feeding unit 2 is smaller than the size specified in the print data, and the image to be printed does not fit on the paper P and must be cut off. The cut flag is initialized to "0", or "OFF", when printing instructions are first received.

As shown in FIG. 6, if the controller 70 receives printing instructions in S1 (S1: YES), then in S2 the CPU 71 of the controller 70 performs a mode determining process. In the mode determining process beginning in S3C of FIG. 8, the CPU 71 determines whether the print data is facsimile data. If facsimile data (S30: YES), then in S44 the CPU 71 stores a "4" in the mode data storage area 731 to select Mode D, since both the existence of paper and the paper width must always be detected. Subsequently, the CPU 71 returns to the printing process. However, if the print data is not facsimile data (S30: NO), then in S31 and S32 the CPU 71 determines what print mode has been specified, and sets the mode according to the specified print mode. Specifically, if a value of "1" has been stored in the priority mode data storage area 732 for selecting the "time priority mode" (S31: YES), then in S41 the CPU 71 selects Mode A by storing a "1" in the mode data storage area 731 in order to shorten the printing time by not detecting either the existence of paper or the paper width. Subsequently, the CPU 71 returns to the printing process in FIG. 6. If the value "2" has been stored in the priority mode data storage area 732 for selecting the "quality priority mode" (S32: YES), then in S44 the CPU 71 selects Mode D by storing a "4" in the mode data storage area 731 so as to detect both the existence of paper and the paper width. Subsequently, the CPU 71 returns to the printing process in FIG. 6.

However, if the printing mode has not been set (S31: NO, S32: NO), then in S33 the CPU 71 obtains resolution data from the print data and sets the mode based on the resolution in S35-S44. Specifically, if the resolution is less than or equal to 600×300 dpi (S35: YES), then in S41 the CPU 71 selects Mode A by storing a "1" in the mode data storage area 731. If the resolution is less than or equal to 750×750 dpi (S37: YES), then in S42 the CPU 71 selects Mode B by storing a "2" in the mode data storage area 731. If the resolution is less than or equal to 1200×1200 dpi (S38: YES), then in S43 the CPU 71 selects Mode C by storing a "3" in the mode data storage area 731. If the resolution is greater than 1200×1200 dpi (S38: NO), then in S44 the CPU 71 selects Mode D by storing a "4" in the mode data storage area 731. Subsequently, the CPU 71 returns to the printing process in FIG. 6.

In S3 of FIG. 6, the CPU 71 performs a paper conveying process for controlling the paper conveying mechanism 14 to convey the paper P to the printing position in order to perform a printing operation. Here, a description will be given for each of modes A, B, C, and D beginning with Mode A. In Mode A, a "1" has been stored in the mode data storage area 731.

If the value stored in the mode data storage area 731 is "1" (S4: YES), indicating Mode A, the CPU 71 does not detect the existence of the paper, but advances directly to S11 shown in FIG. 7. In S11 the CPU 71 determines whether the value in the mode data storage area 731 is "1" or "2". Since the value in the mode data storage area 731 is "1", indicating Mode A (S11: YES), the CPU 71 does not perform a paper width detection, but advances directly to S23 to print one page worth of data. In S24 the CPU 71 determines whether there are more pages to print. If there are more pages to print (S24: YES), the CPU 71 returns to S3 of FIG. 6 and performs a process to convey the next sheet of paper P. Again, the CPU 71 advances directly to S23 to print the next page worth of data without detecting the existence of paper or the paper width (S4: YES, S11: YES). This process is repeated until all pages have been printed (S24: NO), and the printing process ends.

Next, an example of Mode B will be described. In Mode B, a "2" is stored in the mode data storage area 731.

Since a "2" has been stored in the mode data stowage area 731 (S4: NO), indicating that the mode is not Mode A, in S5 the CPU 71 moves the media sensor 68 to a center position of the guide rail 26 where the media sensor 68 can detect the existence of the paper P, regardless of the paper size, and performs a process to detect the existence of the paper P at the center position. If the value outputted from the media sensor 68 exceeds a threshold value for paper edge detection (S6: YES), then the CPU 71 determines that the paper P exists and advances to S11. However, if the value outputted from the media sensor 68 does not exceed the threshold value (S6: NO), then the CPU 71 determines that the paper P does not exist although an operation was performed to feed the paper P. Therefore, since it is not possible to perform a proper printing operation in this case, in S7 the CPU 71 performs an error process for displaying an error message on the LCD panel 7, flashing an error lamp provided on the control panel 6, or the like and ends the printing process.

One possible method for detecting the existence of the paper P with the media sensor 68 is to first convey the paper P to a position at which the media sensor 68 can detect the leading edge of the paper P (the edge on the downstream side of the paper P in the paper conveying direction) and to move the media sensor 68 to a position opposing a paper conveying path R. As shown in FIGS. 3 and 4(*a*), the paper conveying path R is a path (or region) through which the paper P is conveyed for printing. If the media sensor 68 confirms the existence of the paper P at this position, then the CPU 71 determines that the paper feeding process has been properly executed. However, if the existence of the paper P is not confirmed, then the CPU 71 determines that the feeding operation has not been performed properly.

Another possible method for detecting the existence of the paper P is to move the media sensor 68 to the position opposing the paper conveying path R prior to beginning the process to feed the paper P or to move the media sensor 68 to the position opposing the paper conveying path R at least by the time the paper P has been conveyed to a detecting position. If the existence of the paper P is confirmed when the paper feeding operation is completed, then the CPU 71 determines that the feeding operation has been properly performed. However, if the media sensor 68 does not confirm the existence of the paper P after the feeding operation has been completed, then the CPU 71 determines that the feeding operation has not been properly performed.

If the existence of the paper P has been confirmed (S6: YES), then in S11 the CPU 71 determines whether the mode is one of Mode A or Mode B. Since a "2" is stored in the mode data storage area 731, indicating Mode B (S11: YES), the CPU 71 prints a page worth of data in S23 without performing the paper width detection. As in the case of Mode A described above, in S24 the CPU 71 determines whether there are more pages to print. If there are more pages to print (S24: YES), then the CPU 71 returns to S3 of FIG. 6 and performs a process to convey the next sheet of the paper P. In S4-S6, the CPU 71 again detects the existence of paper for the next sheet (S4: NO, S5, S6) and in S23 prints the next sheet worth of data. This process is repeated until all pages have been printed (S24: NO), at which time the printing process ends.

Next, the case of Mode C will be described. In Mode C, a "3" is stored in the mode data storage area 731.

Since a "3" is stored in the mode data storage area 731, indicating that the mode is not Mode A (S4: NO), the CPU 71 performs a process to detect the existence of paper. Hence, in S5 the CPU 71 moves the media sensor 68 to the center position of the guide rail 26 for detecting the existence of paper at the center position. If the value outputted from the media sensor 68 exceeds the threshold value for paper edge detection (S6: YES), then the CPU 71 determines that the paper P exists and advances to S11. However, if the value outputted from the media sensor 68 does not exceed the threshold value (S6: NO), then the CPU 71 determines that the paper P does not exist and, hence, the printing operation cannot be performed properly. Therefore, in S7 the CPU 71 performs the error process to display an error message on the LCD panel 7, flash an error lamp provided on the control panel 6, or the like, and ends the printing process.

Since a "3" is stored in the mode data storage area 731, indicating neither Mode A nor Mode B (S11: NO), in S12 the CPU 71 determines whether the mode is Mode C. Since the mode is Mode C (S12: YES), the CPU 71 performs a process to detect the page width of the first page. Specifically, in S13 the CPU 71 determines whether the first page of the print data is to be printed at this time. Here, "the first page" means the first page in a print job which is currently executed by the multifunction device 1. If information in the print data indicates the first page (S13: YES), then in S15 the CPU 71 moves the media sensor 68 to a position outside the position opposing the paper conveying path R, then detects the width of the paper by moving the media sensor 68 across the paper conveying path R. In other words, the paper width is detected based on an interval corresponding to the paper width in which the output value from the media sensor 68 exceeds the threshold value for paper edge detection. If the width of the paper P is greater than or equal to the paper size specified in the print data (S16: YES), then in S23 the CPU 71 prints one page worth of data.

In S24 the CPU 71 determines whether more pages are to be printed. If more pages are to be printed (S24: YES), then the CPU 71 returns to S3 in FIG. 6 and performs a process to convey the second sheet of paper P. Here, the existence of paper is again detected (S4: NO, S5, S6). However, since the print data is no longer the first page worth of data (S11: NO, S12: YES, S13: NO), the CPU 71 does not perform the paper width detection. Since the paper width was determined to be correct for the first page and the cut flag is still set to "OFF" (S21: YES), the CPU 71 prints one page worth of data in S23. This process is repeated until all pages have been printed (S24: NO), and the printing process ends.

In Mode C, if the CPU 71 determines that the paper width for the first page detected based on the output value from the media sensor 68 is not the proper size (S16: NO), that is, the width of the paper P loaded in the multifunction device 1 is smaller than the width of the paper size specified in the print data, and since the print data for Mode C is not facsimile data (S17: NO), in S18 the CPU 71 sets the cut flag to "ON" by storing a "1" for the cut flag in order to indicate that the portion of image which does not fit on the paper P should be cut so that only the portion of image which fits on the paper P is printed. In S20 print data for the page to be printed is processed in order to generate cut image data that eliminates the portion of image that cannot fit within the detected paper width. In S23 the cut image for this page worth is printed.

In S24 the CPU 71 determines whether there are more pages to be printed. If there are more pages to be printed (S24: YES), the multifunction device 1 returns to S3 in FIG. 6 and performs a process to convey the next sheet of paper P. While the mode continues to be Mode C from the second page on (S4: NO, S6: YES, S11: NO, S12: YES), the print data no longer belongs to the first page (S13: NO). Therefore, in S14 the CPU 71 determines whether the multifunction device 1 has temporarily run out of paper. If the multifunction device 1 has run out of paper and new paper P has been reloaded in the multifunction device 1 (S14; YES), then the CPU 71 repeats the processes in S15-S20 to detect the paper width, even when the data to be printed is for the second page or beyond. Here, the multifunction device 1 is determined to have run out of paper based on whether a "1" is stored in an out-of-paper flag (ON) or a "0" (OFF). The out-of-paper flag is set ON and OFF by a program separate from the printing process. The program monitors the out-of-paper detecting switch 69. The out-of-paper flag is set to "1" (ON) when the out-of-paper detecting switch 69 detects an out-of-paper state. The out-of-paper flag is cleared to "0" (OFF) when printing for one page has been performed after paper P has been reloaded in the multifunction device 1.

If the multifunction device 1 has not run out of paper (S14: NO), then the CPU 71 performs the printing operation without detecting the paper width. However, if the paper width was found to be smaller than the width of the specified size for the first page, then it is necessary to cut off the portion of image that does not fit on the current paper. Hence, if the cut flag is set to "ON" (S21: NO), in S22 the CPU 71 generates a cut image by cutting off the portion of image data that does not fit on the current page and in S23 prints the cut image for one page worth. If the cut flag is set to "OFF" (S21: YES), then in S23 the CPU 71 prints the current page without processing the print data. This process is repeated until all pages have been printed (524: NO), and the printing process ends.

Next, the case of Mode D will be described. In Mode D, a "4" has been stored in the mode data storage area 731.

Since a "4" is stored in the mode data storage area 731, in S4 the CPU 71 determines that the mode is not Mode A (S4: NO) and performs the process to detect the existence of paper. In S5 the CPU 71 moves the media sensor 68 to the center position on the guide rail 26 and detects the existence of paper at the center position. If the value outputted from the media sensor 68 exceeds the threshold value for paper edge detection (S6: YES), then the CPU 71 determines that the paper P exists and advances to S11. However, if the value outputted from the media sensor 68 does not exceed the threshold value (S6: NO), then the CPU 71 determines that the paper P does not exist and, hence, the printing operation cannot be properly performed. Therefore, in S7 the CPU 71 performs an error process to display an error message on the LCD panel 7, flash an error lamp provided on the control panel 6, or the like. Subsequently, the printing process ends.

Further, since a "4" is stored in the mode data storage area 731, the CPU 71 determines that the mode is neither Mode A nor Mode B (S11: NO) and that the mode is not Mode C (S12: NO). Hence, in S15 the CPU 71 performs the process to detect the paper width. If the paper width is determined to be greater than or equal to the width of the paper size specified in the print data based on the values outputted from the media sensor 68 (S16: YES), then in S23 the CPU 71 prints one page worth of data.

In S24 the CPU 71 determines whether more pages are to be printed. If more pages are to be printed (S24: YES), then the CPU 71 returns to S3 in FIG. 6 and performs the process to convey the second sheet of paper P. At this time, the CPU 71 performs the process to detect the existence of paper (S4: NO, S5, S6) and the process to detect the paper width (S11: NO, S12: NO, S15). If the result of the paper width detection is OK (S16: YES), then the CPU 71 prints one page worth of data in S23. This process is repeated until all pages have been printed (S24: NO), and the printing process ends.

If the CPU 71 determines in S16 based on the value outputted from the media sensor 68 that the paper width is not the proper size (S16: NO), and if the print data is not facsimile data (S17: NO), then in SIB the CPU 71 sets the cut flag to "ON". In S20 the CPU 71 processes the print data for the current page to be printed to generate cut image data by cutting the portion of print data that does not fit within the detected page width. In S23 the CPU 71 prints the cum image for one page worth. However, if the print data is facsimile data (S17: YES), then in S25 the CPU 71 performs an error process to display an error message on the LCD panel 7 prompting the user to load paper P of the correct size, flashes an error lamp provided on the control panel 6, or the like. Subsequently, the printing process ends.

The above error process is performed because facsimile data is deleted from the reception buffer memory after being printed on the paper P. Accordingly, if printing were performed when the paper P has not been properly conveyed, the print data would be printed directly on the platen. In this case, not only is an unnecessary printing process performed and the platen soiled, but the content of the facsimile data is erased without being outputted onto the paper P. Further, if the paper loaded in the multifunction device 1 is of an incorrect size or has a small paper width, a portion of the facsimile data will not be printed out, even if the paper P is properly conveyed and the image is cut to match the paper width. Hence, the content of the facsimile data cannot be sufficiently recognized. Therefore, when printing facsimile data, the mode is set to Mode D, as described above, so that the CPU 71 detects both the existence and width of the paper P and only performs the printing process if both conditions are satisfied. This method avoids the loss of facsimile data when the print data cannot be properly printed on the paper P.

Since the multifunction device 1 can control whether to detect the existence of the paper P according to the resolution of the print data, printing quality can be emphasized when the resolution of the image is relatively high, as in photographs. Hence, when the print data requires a large amount of ink, it is possible to prevent the data from being printed at positions outside of the paper P.

However, when the resolution is low, as in draft prints or text-only data, it is possible to put less emphasis on printing quality by not detecting the paper P. In this way, the processing time can be shortened when printing data requires a small amount of ink.

Accordingly, the multifunction device 1 reliably avoids printing mistakes, such as performing a printing operation when no paper is present, without much affecting the overall printing time, when printing high-resolution images with an emphasis on printing quality over printing time. However, if a large amount of time is used for detections prior to printing low-resolution images where printing time is more important than printing quality, the overall printing time will be greatly affected. Therefore, the detection process can be eliminated to shorten the printing time.

Since less ink is used when printing at a low resolution than at a high resolution, even when a printing operation is mistakenly performed without the presence of the paper P, the result is less wasted ink, less soiling of the platen, and, hence, less damage due to the printing mistake. Accordingly, the multifunction device 1 can determine whether to execute a process for detecting the existence of the paper P, based on either the user's degree of priority on printing time or the image resolution which can be basically interpreted as the amount of ink consumption.

The multifunction device 1 can detect the width of the paper P and can control whether or not to detect the width of the paper P based on the resolution of print data. Accordingly, the multifunction device 1 can determine, based on either the user's degree of priority for printing time or the image resolution, whether to execute a process to detect the width of the paper P.

Since the multifunction device 1 detects neither the existence nor width of the paper P in Mode A, the printing time can be shortened when printing in a low resolution with an emphasis on time over quality.

Since the multifunction device 1 detects the existence of the paper P but not the width thereof in Mode B, the print time can be shortened when printing in a low resolution with an emphasis on time over quality. Even when the width of the paper P is different from the predetermined width, there is less soiling of the platen than when the paper P is not conveyed, thereby less affecting the print quality. This control is particularly effective for users who only use one type of print medium or printing devices that can only accommodate one type of print medium.

In Mode C, processing time is reduced by not detecting the width of the paper P from the second page on. If the width of the first page is correct, it is not likely that the paper P loaded in the device will have a different width from the second page on. Accordingly, not detecting the width of the paper P beginning from the second page is an effective method for reducing processing time, since not performing the detection is unlikely to affect the printing quality.

When the multifunction device 1 runs out of paper during a printing process, there is a possibility that the reloaded paper P may be different from that specified in the print data. However, in Mode C, the multifunction device 1 can detect the width of the paper P for the first page to be printed after the paper P is reloaded in this case. Accordingly, the multifunction device 1 can detect when a different paper has been loaded and can control the printing process accordingly to avoid soiling the platen 17. Further, the width is only detected for the first page to be printed after the printer has been reloaded, thereby little affecting printing time.

According to the multifunction device 1 in the above described embodiment, one of the Modes A-D is selected based on the image resolution so that the frequency of detection drops as the resolution drops, thereby shortening the printing time.

According to the multifunction device 1 in the above-described embodiment, a print quality priority mode can be set for detecting the existence of the paper P. Hence the multifunction device 1 can prevent adverse effects on printing quality caused by images being printed directly on the platen 17, even when the resolution is less than or equal to the predetermined resolution. This control is advantageous for a user that wishes to emphasize printing quality over processing time, regardless of resolution, and for users who wish to reduce unnecessary consumption of ink caused by printing malfunctions.

Further, the print time priority mode can be set so that the existence of the paper P is not detected, even when the resolution is greater than the predetermined resolution. This control is advantageous for users who wish to shorten the processing time for all resolutions.

Generally, facsimile data is deleted after completing the printing process for printing the data on the paper P. Hence, if the printing process is performed while the paper P has been conveyed incorrectly, resulting in an image being printed directly on the platen 17, not only is the printing process wasted and the platen 17 soiled, but there is also a risk that the facsimile data will be deleted without the content of the data being outputted in a visible form.

However, the multifunction device 1 in the above described embodiment always detects the existence of the paper P when the print data is facsimile data and only performs the printing process when the paper P has been detected. Accordingly, the multifunction device 1 can prevent the loss of facsimile data before the data has been properly printed onto the paper P. Further, the multifunction device 1 can skip the detection process to reduce the printing time when the data is print data other than facsimile data that is not deleted after the printing process.

The multifunction device 1 in the above-described embodiment can detect the width of the paper P and can determine whether or not to detect the width of the paper P based on whether the image data is facsimile data. The multifunction device 1 always detects the width of the paper P when the data is facsimile data, to avoid cases in which the size of the conveyed paper P is different from the specified size, thereby ensuring that the facsimile data is reliably printed on the paper P. The multifunction device 1 can also reduce the printing time by neither performing the detection of the existence nor the width of the paper P when the print data is not facsimile data (Mode A).

The multifunction device 1 can reduce the printing time by detecting only the existence of the paper P and not the width when the print data is not facsimile data (Mode B). In Mode B, the multifunction device 1 can reduce the printing time while avoiding such printing problems as when the paper P is not conveyed to the correct position.

The multifunction device 1 reduces the processing time when the print data is not facsimile data by not detecting the width of the paper P from the second page on (Mode C).

While the invention has been described in detail with reference to the specific embodiment thereof, it would be apparent to those skilled in the art that various changes and modifications may be made therein without departing from the spirit of the invention.

For example, in the above-described embodiments, an inkjet printer 3 is given as the serial printer in the multifunction device 1 having a facsimile function. However, the serial printer need not be the printer of a multifunction device having a facsimile function, but obviously may also be a device having only a printer function. If the device does not have a facsimile function, then the determination process of S17 is not necessary in the printing process of FIG. 7. Further, the serial printer need not be an inkjet type printer, such as the printer 3, but may instead be a dot impact or thermal transfer serial printer.

Further, in the embodiment described above, the mode of the printer was set to Mode A when the resolution is less than or equal to 600×300 dpi, Mode B when the resolution is less than or equal to 750×750 dpi, Mode C when the resolution is less than or equal to 1200×1200 dpi, and Mode D when the resolution is greater than 1200×1200 dpi. However, it is obvious that these resolutions are only used as an example and that other resolutions may be used. In addition, while four modes A, B, C, and D are used in the embodiment described above, it is also possible to use only three of these modes.

In the embodiment described above, since the paper P is loaded in the multifunction device 1 so as to be centered therein, the media sensor 68 is moved to the center position of the guide rail 26 for detecting the existence of the paper P. However, the position for detecting the existence of paper is not limited to the center position. The media sensor 68 may also be moved to the left edge or right edge for detecting the paper P when the paper P is loaded against the left edge or right edge in the printer.

In the embodiment described above, the mode is determined based on the resolution. However, when using an inkjet serial printer, the mode may instead be determined based on ink coverage (amount of ink droplets).

Figure 9:
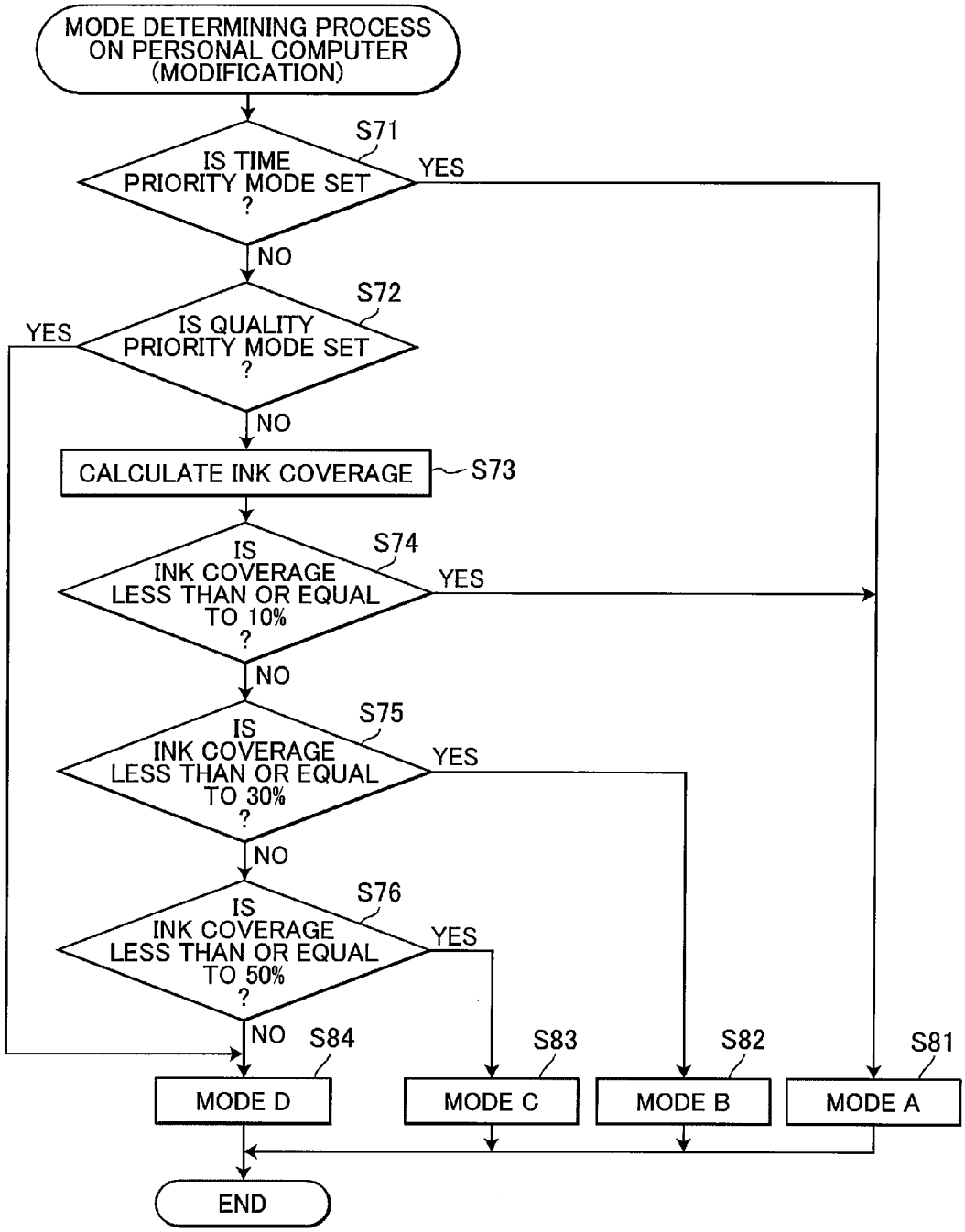
FIG. 9 is a flowchart showing steps in a mode determining process executed on a personal computer connected to the multifunction device according to a modification.

FIG. 9 is a flowchart showing steps in a mode determining process according to a modification. The mode determining process is executed by the personal computer 77 before the personal computer 77 transmits the print data to the inkjet serial printer. In S71 of FIG. 9, the CPU 71 determines whether the time priority mode has been selected. If the time priority mode has been selected (S71: YES), then in S81 the CPU 71 sets the mode to Mode A. If the quality priority mode has been selected (S72: YES), in S84 the CPU 71 sets the mode to Mode D. However, if neither mode has been selected (S71: NO, S72: NO), then in S73 the CPU 71 calculates the ink coverage (amount of ink droplets) in the image.

The ink coverage denotes a ratio of an area covered by ink droplets to an entire printable region of the paper P, and is represented by percentage (%). Hence the ink coverage basically means an amount of ink droplets ejected onto the paper P.

Specifically, the CPU 71 calculates the percentage of ink coverage with the printed image, where 100% coverage is when ink is ejected over the entire printable region of the paper P (complete coverage). If the ink coverage is calculated as less than or equal to 10% (S74: YES), then the CPU 71 sets the mode to Mode A in S81. If the ink coverage is less than or equal to 30% (S75: YES), then the CPU 71 sets the mode to Mode B in S82. If the ink coverage is less than or equal to 50% (S76: YES), then the CPU 71 sets the mode to Mode C in S83. If the ink coverage is greater than 50% (S76: NO), then the CPU 71 sets the mode to Mode D in S84.

After the mode has been determined, a value specifying the determined mode is transmitted along with the print data to the inkjet serial printer. The inkjet serial printer controls detection of the paper existence and paper width based on the mode. The time priority mode or quality priority mode are set on the personal computer 77 using radio buttons, such as "Time Priority Mode," "Quality Priority Mode," and "No Mode Specified" displayed in the print window (not shown) in which the number of copies, page settings, and other advanced settings are made for the printing instructions.

In this modification, the inkjet serial printer that has received the print data performs the same process as the printing process shown in FIGS. 6 and 7, excluding the mode determining process of S2, and controls detection of paper existence and paper width according to the mode set based on ink coverage.

What is claimed is:

1. A serial printer comprising:

a main body formed with a print-medium conveying path through which a print medium is conveyed in a conveying direction, the print medium having a width in a width direction substantially perpendicular to the conveying direction;

a carriage that is movable, with respect to the main body, reciprocatingly in the width direction;

a print head mounted on the carriage for printing an image on the print medium based on print data;

a detector disposed at the carriage for detecting the print medium;

an information acquiring portion that acquires information for determining whether to detect the print medium;

an existence-detection determining portion that determines whether to detect existence of the print medium based on the information acquired by the information acquiring portion;

an existence-detection controlling portion that, when the existence-detection determining portion determines that detection should be performed, controls the carriage to move to a position at which the detector confronts the print-medium conveying path and that controls the detector to detect the existence of the print medium prior to printing; and a print controlling portion that controls the print head and the carriage to print the image based on the print data, the print controlling portion prohibiting the print head and the carriage from printing the image based on the print data when the detector detects no print medium.

2. The serial printer according to claim 1, wherein the information acquiring portion includes a resolution acquiring portion that acquires resolution of the print data; and wherein the existence-detection determining portion includes a first existence-detection determining portion that determines whether to detect the existence of the print medium based on the resolution acquired by the resolution acquiring portion.

3. The serial printer according to claim 2, further comprising:

a width-detection controlling portion that controls the carriage and the detector to detect the width of the print medium; and a first width-detection determining portion that determines whether to detect the width of the print medium based on the resolution acquired by the resolution acquiring portion, wherein the width-detection controlling portion controls the carriage and the detector to detect the width of the print medium prior to printing, when the first width-detection determining portion determines that detection should be performed; and wherein the print controlling portion prohibits the print head and the carriage from printing the image based on the print data at least outside the width of the print medium detected by the detector.

4. The serial printer according to claim 3, wherein, when the resolution acquired by the resolution acquiring portion is less than or equal to a predetermined resolution, the first existence-detection determining portion prohibits the existence-detection controlling portion from detecting the existence of the print medium and the first width-detection determining portion prohibits the width-detection controlling portion from detecting the width of the print medium.

5. The serial printer according to claim 3, wherein, when the resolution acquired by the resolution acquiring portion is less than or equal to a predetermined resolution, the first existence-detection determining portion allows the existence-detection controlling portion to detect the existence of the print medium and the first width-detection determining portion prohibits the width-detection controlling portion from detecting the width of the print medium.

6. The serial printer according to claim 3, further comprising:

a page-number acquiring portion that acquires, prior to printing, a page number in a print job to be printed, wherein the first existence-detection determining portion allows the existence-detection controlling portion to detect the existence of the print medium and the first width-detection determining portion allows the width-detection controlling portion to detect the width of the print medium, when the resolution acquired by the resolution acquiring portion is less than or equal to a predetermined resolution and the page number acquired by the page-number acquiring portion is the first page; and wherein the first existence-detection determining portion allows the existence-detection controlling portion to detect the existence of the print medium and the first width-detection determining portion prohibits the width-detection controlling portion from detecting the width of the print medium, when the resolution acquired by the resolution acquiring portion is less than or equal to the predetermined resolution and the page number acquired by the page-number acquiring portion is equal to or greater than the second page.

7. The serial printer according to claim 6, further comprising:

a printing unit that includes the print head and the carriage;

a print-medium supplying portion that supplies the printing unit with the print medium; and a supply-medium detector that detects whether the print medium exists on the print-medium supplying portion, wherein the first existence-detection determining portion allows the existence-detection controlling portion to detect the existence of the print medium and the first width-detection determining portion allows the width-detection controlling portion to detect the width of the print medium regardless of the page number acquired by the page-number acquiring portion, when the resolution acquired by the resolution acquiring portion is less than or equal to the predetermined resolution and the printing operation is performed for an initial page after the supply-medium detector detects no print medium.

8. The serial printer according to claim 3, further comprising:

a page-number acquiring portion that acquires, prior to printing, a page number in a print job to be printed; and a first mode-selecting portion that selects one of at least three modes based on the resolution acquired by the resolution acquiring portion, the at least three modes being selected from modes including:

a first mode in which the first existence-detection determining portion prohibits the existence-detection controlling portion from detecting the existence of the print medium and the first width-detection determining portion prohibits the width-detection controlling portion from detecting the width of the print medium;

a second mode in which the first existence-detection determining portion allows the existence-detection controlling portion to detect the existence of the print medium and the first width-detection determining portion prohibits the width-detection controlling portion from detecting the width of the print medium;

a third mode in which the first existence-detection determining portion allows the existence-detection controlling portion to detect the existence of the print medium and the first width-detection determining portion allows the width-detection controlling portion to detect the width of the print medium when the page number acquired by the page-number acquiring portion is the first page, while the first existence-detection determining portion allows the existence-detection controlling portion to detect the existence of the print medium and the first width-detection determining portion prohibits the width-detection controlling portion from detecting the width of the print medium when the page number acquired by the page-number acquiring portion is greater than or equal to the second page; and a fourth mode in which the first existence-detection determining portion allows the existence-detection controlling portion to detect the existence of the print medium and the first width-detection determining portion allows the width-detection controlling portion to detect the width of the print medium.

9. The serial printer according to claim 2, further comprising:

a first quality-priority-mode selecting portion that determines whether to select a quality priority mode in which the existence-detection controlling portion controls the detector to detect the existence of the print medium regardless of the resolution acquired by the resolution acquiring portion, wherein the first existence-detection determining portion allows the existence-detection controlling portion to detect the existence of the print medium when the first quality-priority-mode selecting portion selects the quality priority mode, regardless of the resolution acquired by the resolution acquiring portion.

10. The serial printer according to claim 2, comprising:

a first time-priority-mode selecting portion that determines whether to select a time priority mode in which the existence-detection controlling portion prohibits the detector from detecting the existence of the print medium regardless of the resolution acquired by the resolution acquiring portion, wherein the first existence-detection determining portion prohibits the existence-detection controlling portion from detecting the existence of the print medium when the first time-priority-mode selecting portion selects the time priority mode, regardless of the resolution acquired by the resolution acquiring portion.

11. The serial printer according to claim 1, wherein the print head prints the image by ejecting ink on the print medium based on the print data;

wherein the information acquiring portion includes an ink-coverage calculating portion that calculates ink coverage of the print data; and wherein the existence-detection determining portion includes a second existence-detection determining portion that determines whether to detect the existence of the print medium based on the ink coverage calculated by the ink-coverage calculating portion.

12. The serial printer according to claim 11, further comprising:

a width-detection controlling portion that controls the carriage and the detector to detect the width of the print medium; and a second width-detection determining portion that determines whether to detect the width of the print medium based on the ink coverage calculated by the ink-coverage calculating portion, wherein the width-detection controlling portion controls the carriage and the detector to detect the width of the print medium prior to printing, when the second width-detection determining portion determines that detection should be performed; and wherein the print controlling portion prohibits the print head and the carriage from printing the image based on the print data at least outside the width of the print medium detected by the detector.

13. The serial printer according to claim 12, wherein, when the ink coverage calculated by the ink-coverage calculating portion is less than or equal to a predetermined value, the second existence-detection determining portion prohibits the existence-detection controlling portion from detecting the existence of the print medium and the second width-detection determining portion prohibits the width-detection controlling portion from detecting the width of the print medium.

14. The serial printer according to claim 12, wherein, when the ink coverage calculated by the ink-coverage calculating portion is less than or equal to a predetermined value, the second existence-detection determining portion allows the existence-detection controlling portion to detect the existence of the print medium and the second width-detection determining portion prohibits the width-detection controlling portion from detecting the width of the print medium.

15. The serial printer according to claim 12, further comprising:

a page-number acquiring portion that acquires, prior to printing, a page number in a print job to be printed, wherein the second existence-detection determining portion allows the existence-detection controlling portion to detect the existence of the print medium and the second width-detection determining portion allows the width-detection controlling portion to detect the width of the print medium, when the ink coverage calculated by the ink-coverage calculating portion is less than or equal to a predetermined value and the page number acquired by the page-number acquiring portion is the first page; and wherein the second existence-detection determining portion allows the existence-detection controlling portion to detect the existence of the print medium and the second width-detection determining portion prohibits the width-detection controlling portion from detecting the width of the print medium, when the ink coverage calculated by the ink-coverage calculating portion is less than or equal to the predetermined value and the page number acquired by the page-number acquiring portion is equal to or greater than the second page.

16. The serial printer according to claim 15, further comprising:

a printing unit that includes the print head and the carriage;

a print-medium supplying portion that supplies the printing unit with the print medium; and a supply-medium detector that detects whether the print medium exists on the print-medium supplying portion, wherein the second existence-detection determining portion allows the existence-detection controlling portion to detect the existence of the print medium and the second width-detection determining portion allows the width-detection controlling portion to detect the width of the print medium regardless of the page number acquired by the page-number acquiring portion, when the ink coverage calculated by the ink-coverage calculating portion is less than or equal to the predetermined value and the printing operation is performed for an initial page after the supply-medium detector detects no print medium.

17. The serial printer according to claim 12, further comprising:

a page-number acquiring portion that acquires, prior to printing, a page number in a print job to be printed; and a second mode-selecting portion that selects one of at least three modes based on the ink coverage calculated by the ink-coverage calculating portion, the at least three modes being selected from modes including:

a first mode in which the second existence-detection determining portion prohibits the existence-detection controlling portion from detecting the existence of the print medium and the second width-detection determining portion prohibits the width-detection controlling portion from detecting the width of the print medium;

a second mode in which the second existence-detection determining portion allows the existence-detection controlling portion to detect the existence of the print medium and the second width-detection determining portion prohibits the width-detection controlling portion from detecting the width of the print medium;

a third mode in which the second existence-detection determining portion allows the existence-detection controlling portion to detect the existence of the print medium and the second width-detection determining portion allows the width-detection controlling portion to detect the width of the print medium when the page number acquired by the page-number acquiring portion is the first page, while the second existence-detection determining portion allows the existence-detection controlling portion to detect the existence of the print medium and the second width-detection determining portion prohibits the width-detection controlling portion from detecting the width of the print medium when the page number acquired by the page-number acquiring portion is greater than or equal to the second page; and a fourth mode in which the second existence-detection determining portion allows the existence-detection controlling portion to detect the existence of the print medium and the second width-detection determining portion allows the width-detection controlling portion to detect the width of the print medium.

18. The serial printer according to claim 11, further comprising:

a second quality-priority-mode selecting portion that determines whether to select a quality priority mode in which the existence-detection controlling portion controls the detector to detect the existence of the print medium regardless of the ink coverage calculated by the ink-coverage calculating portion, wherein the second existence-detection determining portion allows the existence-detection controlling portion to detect the existence of the print medium when the second quality-priority-mode selecting portion selects the quality priority mode, regardless of the ink coverage calculated by the ink-coverage calculating portion.

19. The serial printer according to claim 11, comprising:

a second time-priority-mode selecting portion that determines whether to select a time priority mode in which the existence-detection controlling portion prohibits the detector from detecting the existence of the print medium regardless of the ink coverage calculated by the ink-coverage calculating portion, wherein the second existence-detection determining portion prohibits the existence-detection controlling portion from detecting the existence of the print medium when the second time-priority-mode selecting portion selects the time priority mode, regardless of the ink coverage calculated by the ink-coverage calculating portion.

20. The serial printer according to claim 1, wherein the serial printer has a facsimile function and the print head is capable of printing the image on the print medium based on facsimile data received by the facsimile function;

wherein the information acquiring portion includes a data determining portion that determines whether the print data are facsimile data; and wherein the existence-detection determining portion includes a third existence-detection determining portion that allows the existence-detection controlling portion to detect the existence of the print medium when the data determining portion determines that the print data are facsimile data.

21. The serial printer according to claim 20, further comprising:

a width-detection controlling portion that controls the carriage and the detector to detect the width of the print medium; and a third width-detection determining portion that determines whether to detect the width of the print medium when the data determining portion determines that the print data are facsimile data, wherein the width-detection controlling portion controls the carriage and the detector to detect the width of the print medium prior to printing, when the third width-detection determining portion determines that detection should be performed; and wherein the print controlling portion prohibits the print head and the carriage from printing the image based on the print data when the detecting portion detects no print medium having a width within which the facsimile data fit.

22. The serial printer according to claim 21, wherein, when the data determining portion determines that the print data are facsimile data, the third existence-detection determining portion allows the existence-detection controlling portion to detect the existence of the print medium and the third width-detection determining portion allows the width-detection controlling portion to detect the width of the print medium; and wherein, when the data determining portion determines that the print data are data other than facsimile data, the third existence-detection determining portion prohibits the existence-detection controlling portion from detecting the existence of the print medium and the third width-detection determining portion prohibits the width-detection controlling portion from detecting the width of the print medium.

23. The serial printer according to claim 21, wherein, when the data determining portion determines that the print data are facsimile data, the third existence-detection determining portion allows the existence-detection controlling portion to detect the existence of the print medium and the third width-detection determining portion allows the width-detection controlling portion to detect the width of the print medium; and wherein, when the data determining portion determines that the print data are data other than facsimile data, the third existence-detection determining portion allows the existence-detection controlling portion to detect the existence of the print medium and the third width-detection determining portion prohibits the width-detection controlling portion from detecting the width of the print medium.

24. The serial printer according to claim 21, further comprising a page-number acquiring portion that acquires, prior to printing, a page number in a print job to be printed, wherein the third existence-detection determining portion allows the existence-detection controlling portion to detect the existence of the print medium and the third width-detection determining portion allows the width-detection controlling portion to detect the width of the print medium, when the data determining portion determines that the print data are facsimile data;

wherein the third existence-detection determining portion allows the existence-detection controlling portion to detect the existence of the print medium and the third width-detection determining portion allows the width-detection controlling portion to detect the width of the print medium, when the data determining portion determines that the print data are data other than facsimile data and the page number acquired by the page-number acquiring portion is the first page; and wherein the third existence-detection determining portion allows the existence-detection controlling portion to detect the existence of the print medium and the third width-detection determining portion prohibits the width detection controlling portion from detecting the width of the print medium, when the data determining portion determines that the print data are data other than facsimile data and the page number acquired by the page-number acquiring portion is equal to or greater than the second page.

25. The serial printer according to claim 24, further comprising:

a printing unit that includes the print head and the carriage;

a print-medium supplying portion that supplies the printing unit with the print medium; and a supply-medium detector that detects whether the print medium exists on the print-medium supplying portion, wherein the third existence-detection determining portion allows the existence-detection controlling portion to detect the existence of the print medium and the third width-detection determining portion allows the width-detection controlling portion to detect the width of the print medium, when the data determining portion determines that the print data are facsimile data; and wherein the third existence-detection determining portion allows the existence-detection controlling portion to detect the existence of the print medium and the third width-detection determining portion allows the width-detection controlling portion to detect the width of the print medium, regardless of the page number acquired by the page-number acquiring portion, when the data determining portion determines that the print data are data other than facsimile data and the printing operation is performed for an initial page after the supply-medium detector detects no print medium.

26. The serial printer according to claim 20, further comprising:

a third quality-priority-mode selecting portion that determines whether to select a quality priority mode in which the existence-detection controlling portion controls the detector to detect the existence of the print medium regardless of whether the data determining portion determines that the print data are facsimile data, wherein the third existence-detection determining portion allows the existence-detection controlling portion to detect the existence of the print medium when the third quality-priority-mode selecting portion selects the quality priority mode, regardless of whether the data determining portion determines that the print data are facsimile data.

* * * * *